US007795954B2

(12) United States Patent
Vice

(10) Patent No.: US 7,795,954 B2
(45) Date of Patent: Sep. 14, 2010

(54) DEVICE FOR PROVIDING SUBSTANTIALLY CONSTANT CURRENT IN RESPONSE TO VARYING VOLTAGE

(75) Inventor: Michael Wendell Vice, El Granada, CA (US)

(73) Assignee: Avago Technologies Wireless IP (Singapore) Pte. Ltd., Singapore (SG)

( * ) Notice: Subject to any disclaimer, the term of this patent is extended or adjusted under 35 U.S.C. 154(b) by 11 days.

(21) Appl. No.: 12/323,848

(22) Filed: Nov. 26, 2008

(65) Prior Publication Data

US 2010/0127765 A1 May 27, 2010

(51) Int. Cl.
*G05F 1/10* (2006.01)
*G05F 3/02* (2006.01)

(52) U.S. Cl. ..... 327/543; 327/538; 323/312; 323/315

(58) Field of Classification Search ..... 327/538, 327/540–543; 323/311, 312, 315
See application file for complete search history.

(56) References Cited

U.S. PATENT DOCUMENTS 5,512,816 A * 4/1996 Lambert ..... 323/315
6,194,920 B1 * 2/2001 Oguri ..... 327/65
6,714,081 B1 * 3/2004 Xu ..... 330/296

* cited by examiner

*Primary Examiner*—Lincoln Donovan
*Assistant Examiner*—Patrick O'Neill

(57) ABSTRACT

A device for providing a substantially constant current includes first and second current mirrors. The first current mirror receives a first amount of a first bias current and provides an output current based on the first amount of the first bias current, the first bias current being based on a fixed voltage. The second current mirror receives a second bias current and a second amount of the first bias current, the second bias current being based on a variable voltage. The second bias current and the second amount of the first bias current vary directly with variations in the variable voltage, and the first amount of the first bias current varies inversely with variations in the variable voltage. The output current remains substantially constant based on the variations in first amount of the first bias current, which counteract effects on the output current by variations in the second voltage.

13 Claims, 3 Drawing Sheets

DEVICE FOR PROVIDING SUBSTANTIALLY CONSTANT CURRENT IN RESPONSE TO VARYING VOLTAGE

BACKGROUND

Highly integrated electronic devices typically require consistent and dependable power supplies to provide reliable operation. For example, portable electronic devices, such as cell phones, personal digital assistance (PDA), electronic games and laptop computers, may include rechargeable batteries, which provide voltage over a wide range, depending on the state of the charge. For instance, when a 3.3V cell phone battery is nearly discharged, it may drop down to as low as 2.7V. However, once the battery is connected to a charger and fully charged, the voltage may be as high as 5.1V, for example, at least during the first period of device operation. Therefore, such electronic devices, which rely on rechargeable batteries (or other varying power source) must be capable of operating over a wide voltage range, e.g., approaching a 2:1 ratio.

Since battery life in portable electronic devices is always a concern, circuits within the portable electronic devices are generally designed to operate with the least possible current draw, while maintaining required gain and linearity. These design constraints are met at the lowest expected battery voltage (e.g., 2.7V in a cell phone). At higher voltages, the circuits usually pull additional current, which accelerates battery discharge and can even compromise performance.

FIG. 1 is a block diagram depicting a conventional bias circuit 100 of an electronic device, used to bias various transistor amplifier stages. The bias circuit 100 includes a power supply voltage source, e.g., a rechargeable battery, for providing a power supply voltage Vdd, connected to a current mirror 110 through resistor R101. The current mirror 110 includes bias or first transistor 111 and amplifier or second transistor 112. Although the second transistor 112 is shown simply as a single transistor for convenience of explanation, it is understood that the second transistor 112 is intended to be representative of various transistors, amplifier stages or other component(s) which are to be biased by the first transistor 111. AC components of the bias circuit 100 are not shown for clarity.

Each of the first and second transistors 111 and 112 may be field-effect transistors (FETs), for example, such as may be field-effect transistors (FETs) or gallium arsenide FETs (GaAsFETs). The first transistor 111 includes a source connected to a low voltage source (e.g., ground), a drain connected to the resistor R101 and a gate connected to a gate of the second transistor 112, as well as to the resistor R101. The second transistor 112 includes a source connected to the low voltage source (e.g., ground), a drain connected to the power supply voltage Vdd and a gate connected to the gate of the first transistor 111.

Referring to FIG. 1, there are two sources of power supply dependence on the drain current Id2 in the second transistor 112, generally speaking. The first source is the effect of the power supply voltage Vdd on the drain current Id1 of the first transistor 111, which is mirrored into the drain of the second transistor 112. The second source is the direct effect of drain-source voltage Vds on the drain current Id2 within the amplifier transistor 112 itself. The drain-source voltage Vds is the voltage across the drain and source of the second transistor 112, which is equivalent to the voltage at node Vd2 when the source of the second transistor 112 is connected to ground. The second effect is depicted in FIG. 2, for example, which includes graph 200 showing current versus voltage (I-V) characteristics with respect to Id2 and Vds in the second transistor 112.

As shown in FIG. 2, a significant amount of voltage dependent current in the second transistor 112 is seen from the characteristics of the second transistor 112 alone. For example, the graph of FIG. 2 depicts an attempt to maintain 10 mA of drain current Id2 in the second transistor 112 by fixing gate-source voltage Vgs. The gate-source voltage Vgs is the voltage across the gate and source of the second transistor 112, which is equivalent to the voltage at node Vg2 when the source of the second transistor 112 is connected to ground. However, variation in the drain-source voltage Vds of the second transistor 112 is responsive to variations in power supply voltage Vdd. This causes, for example, an undesirable dependence of the drain current Id2, in which the drain current Id2 continues to increase (i.e., above the target current of 10 ma) as the drain-source voltage Vds increases in response to the power supply voltage Vdd increasing. This direct correspondence may result in excessive current when the battery is in a fully charged state, as well in starvation as the battery discharges.

SUMMARY

In a representative embodiment, a device for providing a substantially constant current includes first and second current mirrors. The first current mirror is configured to receive a first amount of a first bias current and to provide an output current based on the first amount of the first bias current, the first bias current being based on a fixed voltage from a first voltage source. The second current mirror is configured to receive a second bias current and a second amount of the first bias current, the second bias current being based on a variable voltage from a second voltage source. The second bias current and the second amount of the first bias current vary directly with respect to variations in the variable voltage, and the first amount of the first bias current varies inversely with respect to the variations in the variable voltage. The output current remains substantially constant based on the variations in first amount of the first bias current, which counteract effects on the output current by the variations in the second voltage.

In another representative embodiment, a device for providing a substantially constant current includes first and second current mirrors. The first current mirror includes a first transistor connected to a fixed voltage source through a first resistor, which provides a first bias current, and a second transistor connected to a variable voltage source, a drain current of the first transistor comprising a first amount of the first bias current. The second current mirror includes a third transistor connected to the variable voltage source through a second resistor, which provides a second bias current, and a fourth transistor connected to the fixed voltage source through the first resistor. A drain current of the fourth transistor includes a second amount of the first bias current. The second bias current increases in response to an increase in a variable voltage from the variable voltage source, and is mirrored into the fourth transistor by the third transistor through the second current mirror, increasing the second amount of the first bias current. The first amount of the first bias current decreases in response to the increased second amount of the first bias current, the decreased first amount of first bias current being mirrored into the second transistor by the first transistor through the first current mirror, the mirrored first amount of the first bias current compensating for a potential increase in a drain current of the second transistor caused by the increase in the variable voltage to provide the substantially constant current.

In another representative embodiment, an apparatus includes first through fourth transistors. The first transistor includes a drain connected to a fixed voltage source through a first resistor and a source connected to a low voltage source, a first drain current of the first transistor including an amount of a first bias current from the first resistor steered to the first transistor. The second transistor includes a drain connected to a variable voltage source, a source connected to the low voltage source, and a gate connected to a gate of the first transistor to form a first current mirror. The first drain current is mirrored into the second transistor through the first current mirror such that a second drain current of the second transistor is proportional to the first drain current. The third transistor includes a drain connected to the variable voltage source through a second resistor and a source connected to the low voltage source, a third drain current of the third transistor includes a second bias current from the second resistor. The fourth transistor includes a drain connected to the fixed voltage source through the first resistor, a source connected to the low voltage source, and a gate connected to the gate of the third transistor to form a second current mirror. The third drain current is mirrored into the fourth transistor through the second current mirror, such that a fourth drain current of the fourth transistor is proportional to the third drain current.

An increase in a variable voltage of the variable voltage source causes an increase in the third drain current, which causes an increase in the fourth drain current, which causes a decrease in the amount of the first bias current steered to the first transistor and thus a decrease in the first drain current, which causes a decrease in the second drain current. The decrease in the second drain current counteracts a potential increase in the second drain current which would have occurred in response to the increase in the variable voltage and maintains the second drain current at a substantially constant value.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Figure 3:
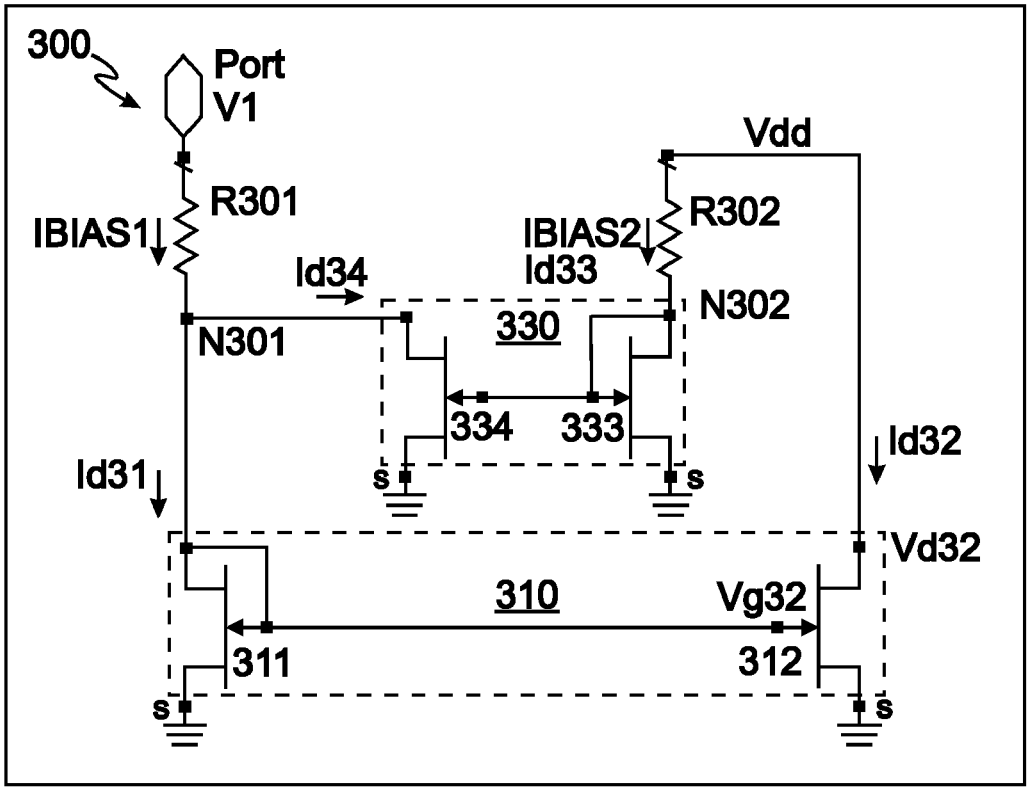
FIG. 3 is a block diagram illustrating a bias circuit, according to a representative embodiment.

FIG. 3 is a block diagram depicting a power supply voltage invariant bias circuit 300 of an electronic device, according to a representative embodiment. The bias circuit 300 reduces or eliminates dependence of transistor bias current on power supply voltage, and may be used to bias various transistor amplifier stages, for example. Throughout all of the drawings, AC components are not shown for clarity, as would be appreciated by one of ordinary skill in the art.

The bias circuit 300 includes a power supply voltage source, e.g., a rechargeable battery or other variant voltage source, for providing power supply voltage Vdd, connected to first and second current mirrors 310 and 330, and a fixed voltage source, for providing fixed input voltage V1, connected to the first and second current mirrors 310 and 330. The fixed input voltage V1 may be fixed by any suitable technique, such as a voltage clamp circuit, an example of which is discussed below with respect to FIG. 5.

The first current mirror 310 includes first transistor 311 and second transistor 312, which may be bias and amplifier transistors, respectively. The first transistor 311 includes a source connected to a low voltage source (e.g., ground), a drain connected to node N301, and a gate connected to a gate of the second transistor 312, as well as to the node N301. The node N301 is connected to the fixed input voltage V1 through resistor R301, and thus receives first bias current IBIAS1. The second transistor 312 includes a source connected to the low voltage source, a drain connected to power supply voltage Vdd and a gate connected to the gate of the first transistor 311. Although the second transistor 312 is shown simply as a single transistor for convenience of explanation, it is understood that the second transistor 312 is intended to be representative of various transistors, amplifier stages or other component(s) which may be biased by the first transistor 311.

The second current mirror 330 includes third transistor 333 and fourth transistor 334. The third transistor 333 includes a source connected to a low voltage source (e.g., ground), a drain connected to node N302 and a gate connected to the gate of the fourth transistor 334, as well as to the node N302. The node N302 is connected to the power supply voltage Vdd through resistor R302, and thus receives second bias current IBIAS2. The fourth transistor 334 includes a source connected to a low voltage source, a drain connected to the node N301 and a gate connected to the gate of the third transistor 333. In various embodiments, the low voltage sources are not necessarily the same, although transistors within a given current source may be connected to the same low voltage source, either directly or through resistors of proportional value.

The first through fourth transistors 311, 312, 333 and 334 may be field-effect transistors (FETs), such as gallium arsenide FETs (GaAsFETs), for example. However, other types of FETs and/or other types of transistors within the purview of one of ordinary skill in the art may be incorporated into the bias circuit 300, without departing from the spirit and scope of the present teachings. For example, the first through fourth transistors 311, 312, 333 and 334 may be other types of transistors, such as metal-oxide FETs (MOSFETs), silicon bipolar junction transistors (BJTs), high electron mobility transistors (HEMTs), pseudomorphic HEMTs, heterostructure FETs (HFETs), junction-gate FETs (JFETs), metal-semiconductor FETs (MESFETs), etc.

Further, it is understood that the sources/drains of the various transistors may be reversed, without affecting the relevant functionality of the exemplary bias circuit 300, depending on design factors of various embodiments. Also, as will be appreciated by one having ordinary skill in the art, it is understood that the bias circuit 300 may be implemented using bipolar technology.

Referring to FIG. 3, the fixed input voltage V1 provided by the fixed voltage source supplies the first bias current IBIAS1 through the resistor R301. Meanwhile, the power supply voltage Vdd provided by the variable power supply supplies the second bias current IBIAS2 through the resistor R302. As stated above, the power supply voltage Vdd varies. For example, when the power supply is a battery, the power supply voltage Vdd may increase when the battery is fully charged and decrease as the battery discharges.

Figure 1:
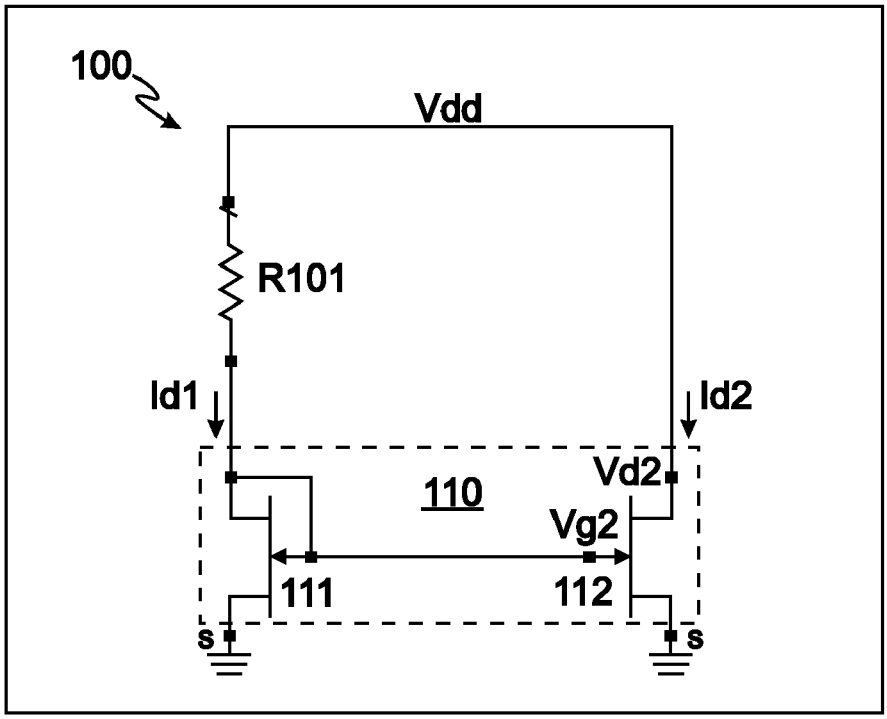
FIG. 1 PRIOR ART
FIG. 1 is a block diagram illustrating a conventional bias circuit of a portable electronic device.

Increases in the power supply voltage Vdd increases the drain-source voltage Vds of the second transistor 312, and tends to increase the drain current Id32 of the second transistor 312 as well, e.g., as discussed above with respect to the second transistor 112 in FIG. 1. In addition, as the power supply voltage Vdd increases, the second bias current IBIAS2 through the second resistor R302 likewise increases. Therefore, the drain current Id33 of the third transistor 333, which is substantially the same as the bias current IBIAS2, also increases. The increased drain current Id33 of the third transistor 333 is mirrored into the drain of the fourth transistor 334 through the second current mirror 330, thus increasing the corresponding drain current Id34 of the fourth transistor 334.

Meanwhile, the first bias current IBIAS1 from resistor R301 is divided to provide drain current Id34 of the fourth transistor and drain current Id31 of the first transistor 311. Accordingly, when the drain current Id34 increases, for example, more of the first bias current IBIAS1 is steered toward the fourth transistor 334 and away from the first transistor 311. Therefore, the drain current Id31 of the first transistor 311 decreases. In other words, the fourth transistor 334 effectively "steals" a larger amount of the first bias current IBIAS1, which otherwise would have reached the first transistor 311, reducing the amount of the bias current IBIAS1 at the drain of the first transistor 311. Thus, generally, an increase in the power supply voltage Vdd causes an increase in the drain current Id33 of the third transistor 333, which causes an increase in the drain current Id34 of the fourth transistor 334, which causes a decrease in the drain current Id31 of the first transistor 311.

Figure 4:
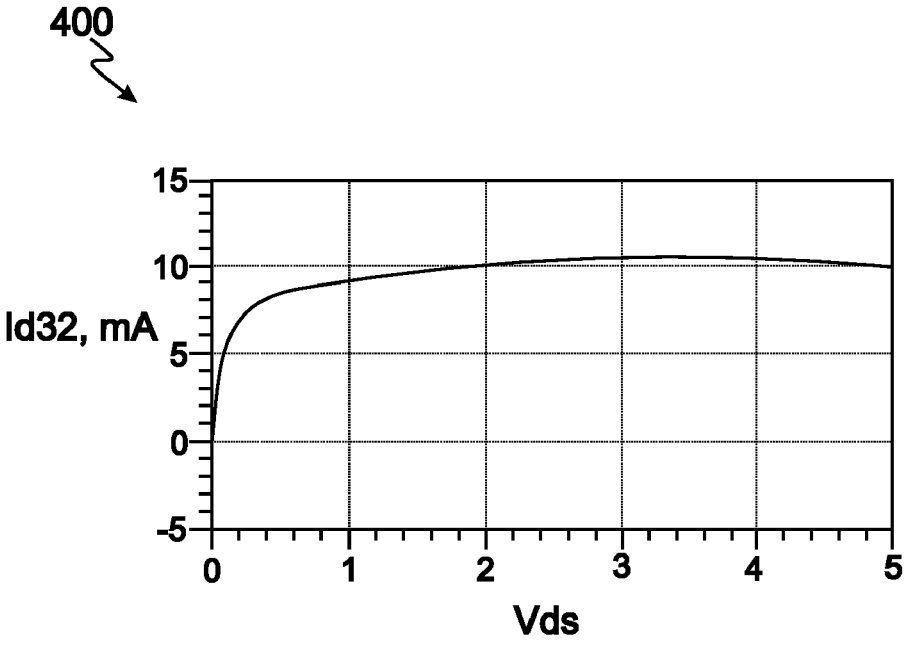
FIG. 4 is a graph illustrating drain current versus voltage in a bias circuit, according to a representative embodiment.

The decreased drain current Id31 is mirrored into the drain of the second transistor 312 through the first current mirror 310, causing a gate voltage Vg32 on the second transistor 312 to decrease. This decrease in gate voltage Vg32 results in lowering the drain current Id32 of the second transistor 312, which otherwise tends to increase in response to an increase in power supply voltage Vdd, as stated above. Thus, this decrease in the drain current Id32 caused by the mirrored drain current Id31 effectively counteracts or compensates for the tendency of the drain current Id32 to increase in response to the increasing power supply voltage Vdd. Accordingly, the drain current Id32 of the second transistor 312 remains relatively constant as the power supply voltage Vdd and the drain-source voltage Vds of the second transistor 312 increase, as shown in the graph of FIG. 4, for example. As discussed above, the drain-source voltage Vds is effectively equivalent to the drain voltage at node Vd32 when the source of the second transistor 312 is connected to ground. The drain current Id32 may be output as a constant current.

Figure 2:
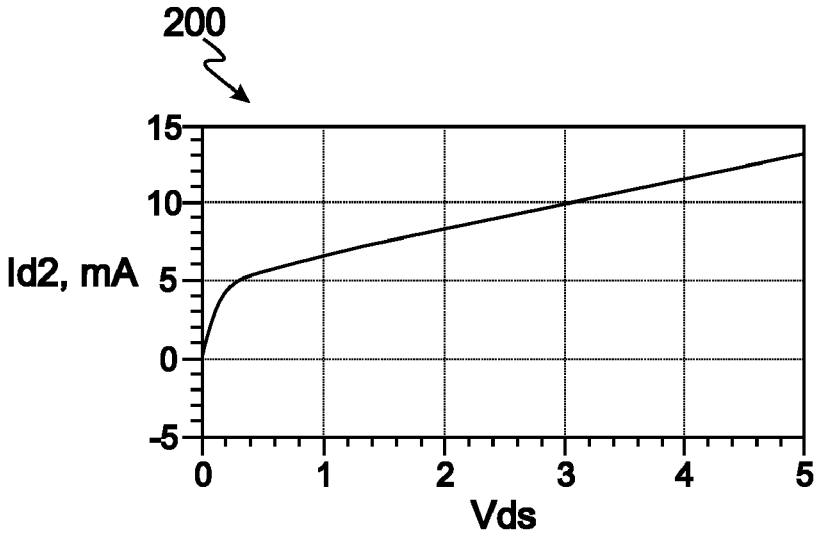
FIG. 2 PRIOR ART
FIG. 2 is a graph illustrating drain current versus voltage in a conventional bias circuit.

More particularly, FIG. 4 includes graph 400 showing I-V characteristics with respect to the drain current Id32 and drain-source voltage Vds in the second transistor 312. The graph 400 depicts an attempt to maintain 10 mA of drain current Id32 in the second transistor 312, according to the representative embodiment depicted in FIG. 3. As the drain-source voltage Vds of the second transistor 312 increases to about 1.7V in response to increases in the power supply voltage Vdd, the drain current Id32 reaches about 10 mA. However, the drain current Id32 then substantially remains at that level, even as the drain-source voltage Vds continues to increase. Thus, the bias circuit 300 compensates for the otherwise sloped I-V curve of the second transistor 312 (as shown for the second transistor 112 in FIG. 2, for example), so that the drain current Id32 is maintained over a wide voltage range.

Although not shown in FIG. 4, it is understood that the stabilization of the drain current Id32 in the second transistor 312 also works as the power supply voltage Vdd (and consequently the drain-source voltage Vds of the second transistor 312) decreases, or otherwise fluctuates within a range of voltages (e.g., between 2.7V and 5.1V). For example, a decrease in the power supply voltage Vdd causes a decrease in the second bias current IBIAS2/drain current Id33 of the third transistor 333, which is mirrored into the drain of the fourth transistor 334, causing a decrease in the drain current Id34. The decreased drain current Id34 results in less current of the first bias current IBIAS1 being steered toward the fourth transistor 334 and more current of the first bias current IBIAS1 being steered toward the first transistor 311, thus increasing the drain current Id31 of the first transistor 311.

The increased drain current Id31 is mirrored into the drain of the second transistor 312 through the first current mirror 310, increasing the drain current Id32 of the second transistor. The amount of increase in the drain current Ids32 effectively offsets or counteracts any amount of decrease in the drain current Id32 that would otherwise have occurred in response to the decrease in the power supply voltage Vdd (and the drain-source voltage Vds). In other words, the drain current Id32 will remain at about 10 mA, at least until the drain-source voltage Vds drops below the minimum threshold voltage (e.g., 1.7V) in response to the decreased power supply voltage Vdd.

In order to provide a constant drain current Id32 of the second transistor 312, the ratio of the various component values may be optimized. For example, in an illustrative embodiment, the first and second transistors 311 and 312 of the first current mirror 310 may have the same length, and the first transistor 311 may have a width of about 15 μm and the second transistor 312 has a width of about 300 μm. In this representative configuration, the drain current Id32 of the second transistor 312 is approximately 20 times that the drain current Id31 of the first transistor 311. As discussed above, the drain current Id32 varies in proportion to the drain current Id31.

The third and fourth transistors 333 and 334 of the second current mirror 330 may have the same length and width. In various embodiments, the width ratio of the third and fourth transistors 333 and 334 need not be identical, but rather may have any scale factor. Functionality may then be recovered, for example, by a compensating change in the value of the bias resistor feeding the drain of the third transistor 333. In the representative configuration, the drain current Id34 of the fourth transistor 334 is substantially the same as the drain current Id33 of the third transistor 333. As discussed above, the drain current Id34 varies in proportion to the drain current Id33.

With respect to resistance values, the resistance of resistor R302 may be about four times greater that the resistance of resistor R301. The fixed input voltage V1 may be regulated to about 1.6V, for example, and the power supply voltage Vdd may be about 3.3V, nominally. Accordingly, the drain current Id32 in the second transistor 312 is effectively maintained at 10 mA, even as the power supply voltage Vdd increases or decreases. It is understood that the sizes of the various transistors 311, 312, 333 and 334, the resistance values of resistors R301 and R302, and the voltages V1 and Vdd may vary to provide unique benefits for any particular situation or to meet application specific design requirements of various implementations, as would be apparent to one skilled in the art.

Figure 5:
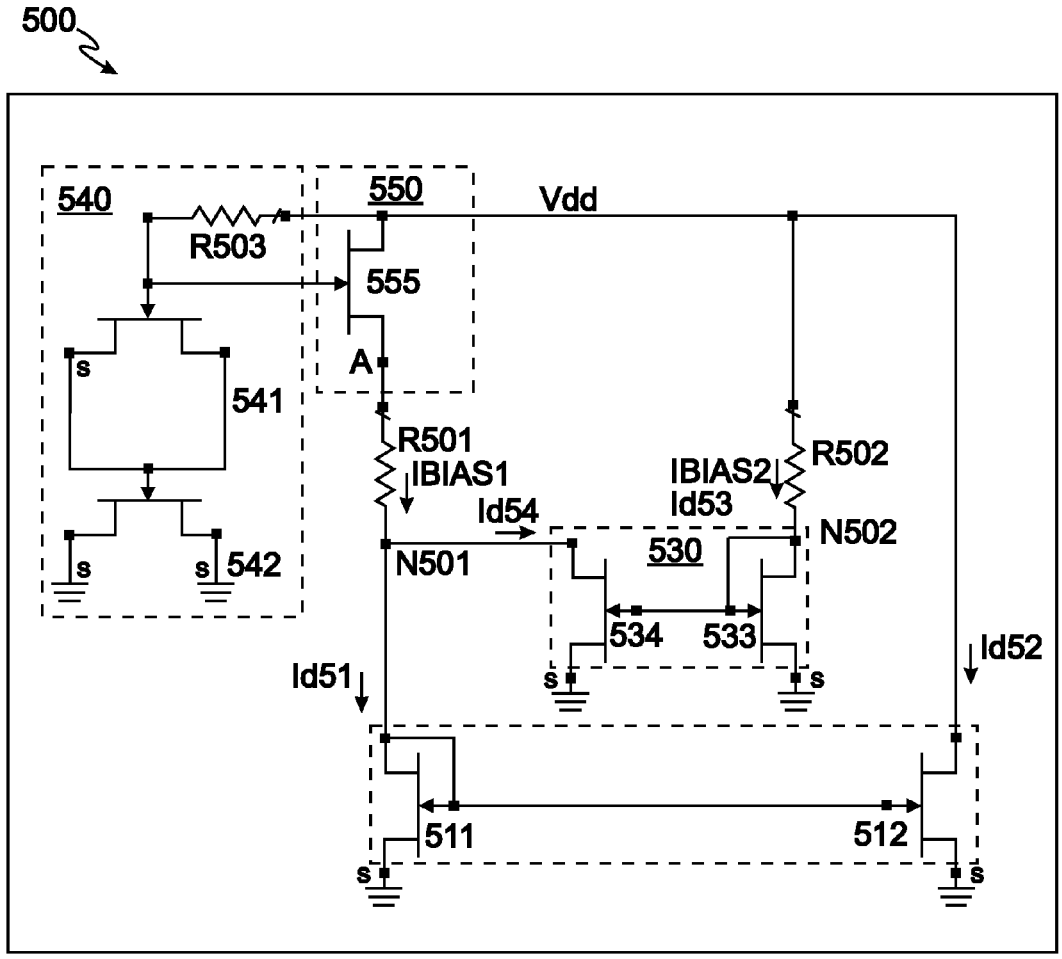
FIG. 5 is a block diagram illustrating a bias circuit, according to another representative embodiment.

FIG. 5 is a block diagram depicting a power supply voltage invariant bias circuit 500 of an electronic device, according to another representative embodiment. The bias circuit 500 may be used to bias various transistor amplifier stages, for example, and reduces or substantially eliminates dependence of transistor bias current on power supply voltage.

The bias circuit 500 has a voltage regulator or voltage clamp circuit including voltage clamp 540 and source follower buffer 550, which regulate the voltage at node A to provide a fixed input voltage V1 applied to resistor R501. The voltage clamp 540 may be a diode clamp, for example, having a resistor R503 and a pair of diodes, indicated by first and second diode transistors 541 and 542. The first diode transistor 541 includes a gate connected to the resistor R503 and a source and a drain connected to one another, and the second diode transistor 542 includes a gate connected to the combined source and drain of the first diode transistor 541 and a source and a drain connected to a low voltage source (e.g., ground). The resistor R503 is connected between the gate of the first diode transistor 541 and a power supply voltage source, e.g., a rechargeable battery, for providing power supply voltage Vdd.

The source follower buffer 550 of the voltage clamp circuit includes a buffer transistor 555. The buffer transistor 555 includes a gate connected to the gate of the first diode transistor 541, a drain connected to the power supply voltage source and a source connected to node A. Accordingly, the voltage at node A is clamped to a specific value (e.g., fixed input voltage V1), regardless of the value of the power supply voltage Vdd.

It is understood that the sizes of the various transistors 541, 542 and 555, and the resistance value of resistor R503, may vary to provide unique benefits for any particular situation or to meet application specific design requirements of various implementations, as would be apparent to one skilled in the art. It is further understood that the clamp circuit including voltage clamp 540 and source follower buffer 550 illustrates one technique by which fixed input voltage V1 may be provided, e.g., to bias circuit 500. Any means of regulating a fixed input voltage V1 at a constant value may be included without departing from the spirit and scope of the present disclosure. For example, the voltage clamp is not limited in the number of diode transistors that may be included. Also, the functionality of the diode transistors 541 and 542 may be implemented using diodes instead of diode transistors.

In addition, the bias circuit 500 includes first and second current mirrors 510 and 530 connected to the power supply voltage Vdd, which are configured and operate in substantially the same manner as described above with respect to first and second current mirrors 310 and 330 in FIG. 3. The first current mirror 510 includes first transistor 511 and second transistor 512, which may be bias and amplifier transistors, respectively. The first transistor 511 includes a source connected to a low voltage source (e.g., ground), a drain connected to node N501, and a gate connected to a gate of the second transistor 512, as well to as the node N501. The node N501 is connected to the voltage clamp circuit through resistor R501, and thus receives first bias current IBIAS1. The second transistor 512 includes a source connected to a low voltage source, a drain connected to power supply voltage Vdd and a gate connected to the gate of the first transistor 511. Although the second transistor 512 is shown simply as a single transistor for convenience of explanation, it is understood that the second transistor 512 is intended to be representative of various transistors, amplifier stages or other component(s) which are to be biased by the first transistor 511.

The second current mirror 530 includes third transistor 533 and fourth transistor 534. The third transistor 533 includes a source connected to a low voltage source, a drain connected to node N502 and a gate connected to a gate of the fourth transistor 534, as well as to the node N502. The node N502 is connected to the power supply voltage Vdd through resistor R502, and thus receives second bias current IBIAS2. The fourth transistor 534 includes a source connected to a low voltage source, a drain connected to the node N501 and a gate connected to the gate of the third transistor 533.

As stated above, the first and second current mirrors 510 and 530 of the bias circuit 500 operate in substantially the same manner as the first and second current mirrors 310 and 330 of the bias circuit 300, discussed above, although the fixed input voltage V1 is shown as being provided by the voltage clamp circuit, including the voltage clamp 540 and the source follower buffer 550. That is, the drain current Id52 of the second transistor 512 varies inversely with respect to changes in the power supply voltage Vdd (and directly with respect to changes in drain current Id51), so that the drain current Id52 remains relatively constant despite fluctuations in the power supply voltage Vdd.

For example, an increase in the power supply voltage Vdd causes an increase in the second bias current IBIAS2 and the drain current Id53 (which is substantially equal to the second bias current IBIAS2) of the third transistor 533. The drain current Id53 is mirrored into the fourth transistor 534 through the second current mirror 530, causing an increase in the drain current Id54 of the fourth transistor 554. Accordingly, more current of the first bias current IBIAS1 is steered toward the fourth transistor 534 and less current of the first bias current IBIAS1 is steered toward the first transistor 511, thus decreasing the drain current Id51 of the first transistor 511.

The decreased drain current Id51 is mirrored into the drain of the second transistor 512 through the first current mirror 510, decreasing the drain current Id52 of the second transistor 512. The amount of decrease in the drain current Id52 effectively offsets or counteracts an amount of increase in the drain current Id52 that would otherwise have occurred in response to the increase in the power supply voltage Vdd and the drain-source voltage Vds of the second transistor 512. Conversely, in a similar manner, a decrease in the power supply voltage Vdd ultimately results in a corresponding increase in the drain current Id52 of the second transistor 512 to effectively offset or counteract an amount of decrease in the drain current Id52 that would otherwise have occurred in response to the decrease in the power supply voltage Vdd and the drain-source voltage Vds52. Accordingly, the drain current Id52 current is maintained over a wide voltage range.

Figure 6:
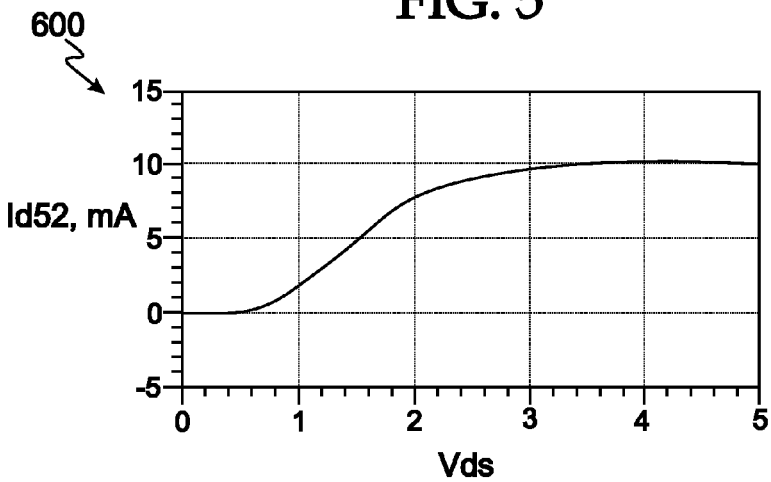
FIG. 6 is a graph illustrating drain current versus voltage in a bias circuit, according to a representative embodiment.

For example, FIG. 6 includes graph 600 showing I-V characteristics with respect to the drain current Id52 and drain-source voltage Vds in the second transistor 512. The graph 600 depicts an attempt to maintain 10 mA of drain current Id52 in the second transistor 512, according to the representative embodiment depicted in FIG. 5. As the drain-source voltage Vds of the second transistor 512 increases to about 2.7V in response to increases in the power supply voltage Vdd, the drain current Id52 reaches about 10 mA. The drain current Id52 then remains substantially at that level, even as the drain-source voltage Vds continues to increase. Thus, the bias circuit 500 compensates for the otherwise sloped I-V curve of the second transistor 512 (as shown for the second transistor 112 in FIG. 2, for example), so that the drain current Id52 is maintained over a wide voltage range.

The first through fourth transistors 511, 512, 533 and 534, as well as the diode transistors 541 and 542 and the buffer transistor 555, may be FETs, such as GaAsFETs, for example. However, other types of FETs and/or other types of transistors within the purview of one of ordinary skill in the art may be incorporated into the bias circuit 500, without departing from the spirit and scope of the present teachings, including MOSFETs, BJTs, HEMTs, pseudomorphic HEMTs, HFETs, JFETs, MESFETs, etc. Further, it is understood that the sources/drains of the various transistors may be reversed, without affecting the relevant functionality of the exemplary bias circuit 500, depending on design factors of various embodiments. Also, as will be appreciated by one having ordinary skill in the art, the bias circuit 500 may be implemented using bipolar technology.

The illustrative embodiments of the bias circuit in an electronic device including multiple current mirrors. The current mirrors enable a drain current, e.g., of an amplifier transistor, to remain substantially constant, even as a power supply voltage varies within an operable range.

In view of this disclosure it is noted that variant circuits can be implemented in keeping with the present teachings. Further, the various components, materials, structures and parameters are included by way of illustration and example only and not in any limiting sense. In view of this disclosure, those skilled in the art can implement the present teachings in determining their own applications and needed components, materials, structures and equipment to implement these applications, while remaining within the scope of the appended claims.

The invention claimed is:

1. A device for providing a substantially constant current, comprising:

a first current mirror comprising a first transistor connected to a fixed voltage source through a first resistor, which provides a first bias current, and a second transistor connected to a variable voltage source, a drain current of the first transistor comprising a first amount of the first bias current; and a second current mirror comprising a third transistor connected to the variable voltage source through a second resistor, which provides a second bias current, and a fourth transistor connected to the fixed voltage source through the first resistor, a drain current of the fourth transistor comprising a second amount of the first bias current, wherein the second bias current increases in response to an increase in a variable voltage from the variable voltage source, and is mirrored into the fourth transistor by the third transistor through the second current mirror, increasing the second amount of the first bias current, and wherein the first amount of the first bias current decreases in response to the increased second amount of the first bias current, the decreased first amount of first bias current being mirrored into the second transistor by the first transistor through the first current mirror, the mirrored first amount of the first bias current compensating for a potential increase in a drain current of the second transistor caused by the increase in the variable voltage to provide the substantially constant current.

2. The device of claim 1, wherein the variable voltage source comprises a rechargeable battery.

3. The device of claim 2, wherein the fixed voltage source comprises a voltage clamp circuit.

4. The device of claim 1, wherein the second bias current decreases in response to a decrease in the variable voltage from the variable voltage source, and the decreased second bias current is mirrored into the fourth transistor by the third transistor through the second current mirror, decreasing the second amount of the first bias current, and wherein the first amount of the first bias current increases in response to the decreased second amount of the first bias current, and the increased first amount of the first bias current is mirrored into the second transistor by the first transistor through the first current mirror, the mirrored first amount of the first bias current compensating for a potential decrease in a drain current of the second transistor caused by the decrease in the variable voltage to provide the substantially constant current.

5. The device of claim 1, wherein the variable voltage source comprises a battery and the fixed voltage source comprises a voltage regulator.

6. The device of claim 5, wherein the voltage regulator comprises:

a buffer circuit comprising a buffer transistor connected between the first resistor and the battery; and a voltage clamp comprising a first diode transistor, a second diode transistor and a third resistor, the first diode transistor being gated to the third resistor and a gate of the buffer transistor, and the second diode transistor being gated to a source and a drain of the first diode transistor.

7. The apparatus of claim 1, wherein each of the first through fourth transistors comprises a gallium arsenide field effect-transistor (GaAsFET).

8. An apparatus, comprising:

a first transistor comprising a drain connected to a fixed voltage source through a first resistor and a source connected to a low voltage source, a first drain current of the first transistor comprising an amount of a first bias current from the first resistor steered to the first transistor;

a second transistor comprising a drain connected to a variable voltage source, a source connected to the low voltage source, and a gate connected to a gate of the first transistor to form a first current mirror, the first drain current being mirrored into the second transistor through the first current mirror such that a second drain current of the second transistor is proportional to the first drain current;

a third transistor comprising a drain connected to the variable voltage source through a second resistor and a source connected to the low voltage source, a third drain current of the third transistor comprising a second bias current from the second resistor; and a fourth transistor comprising a drain connected to the fixed voltage source through the first resistor, a source connected to the low voltage source, and a gate connected to the gate of the third transistor to form a second current mirror, the third drain current being mirrored into the fourth transistor through the second current mirror such that a fourth drain current of the fourth transistor is proportional to the third drain current, wherein an increase in a variable voltage of the variable voltage source causes an increase in the third drain current, which causes an increase in the fourth drain current, which causes a decrease in the amount of the first bias current steered to the first transistor and thus a decrease in the first drain current, which causes a decrease in the second drain current, the decrease in the second drain current counteracting a potential increase in the second drain current which would have occurred in response to the increase in the variable voltage and maintaining the second drain current at a substantially constant value.

9. The apparatus of claim 8, wherein the fourth drain current of the fourth transistor is substantially equal to the third drain current of the third transistor.

10. The apparatus of claim 8, wherein a decrease in the variable voltage causes a decrease in the third drain current, which causes a decrease in the fourth drain current, which causes an increase in the amount of the first bias current steered to the first transistor and thus an increase in the first drain current, which causes an increase in the second drain current, the increase in the second drain current counteracting a potential decrease in the second drain current which would have occurred in response to the decrease in the variable voltage and maintaining the second drain current at the substantially constant value.

11. The apparatus of claim 8, further comprising:

a voltage clamp circuit configured to provide the fixed voltage.

12. The apparatus of claim 11, wherein the voltage clamp circuit comprises:

a third resistor;

a fifth transistor comprising a source, a drain, and a gate connected to the third resistor;

a sixth transistor comprising a source and a drain connected to the low voltage source, and a gate connected to the source and the drain of the fifth transistor; and a seventh transistor comprising a source connected to the first resistor, a drain connected to the third resistor, and a gate connected to the gate of the fifth transistor.

13. The apparatus of claim 12, wherein each of the first through seventh transistors comprises a gallium arsenide field effect-transistor (GaAsFET).

* * * * *